United States Patent [19]

White

[11] Patent Number: 4,821,986

[45] Date of Patent: Apr. 18, 1989

[54] MULTIPLE LEG FURNITURE BASE

[75] Inventor: Winsor White, Chicago, Ill.

[73] Assignee: Steelcase Inc., Grand Rapids, Mich.

[21] Appl. No.: 151,918

[22] Filed: Feb. 3, 1988

[51] Int. Cl.[4] ..... A47B 13/00

[52] U.S. Cl. ..... 248/188.7

[58] Field of Search ..... 248/677, 519, 529, 151, 248/163.1, 165, 188, 188.7, 188.8; 108/150, 151; 403/217, 218, 219, 174, 178

[56] References Cited

U.S. PATENT DOCUMENTS

| | | | |
|---|---|---|---|
| 1,173,328 | 2/1916 | Travers | 248/188.7 |
| 1,717,142 | 6/1929 | Bump | 248/188.7 |
| 2,172,019 | 9/1939 | Brainard | 248/188.7 |
| 3,347,509 | 10/1967 | Holz | 248/188.7 |
| 3,443,782 | 5/1969 | Fields | 248/188.7 |
| 3,484,067 | 12/1969 | Fulper | 248/44 |
| 3,497,170 | 2/1970 | Armstrong | 248/188.7 |
| 3,655,156 | 4/1972 | Petrie | 248/48 |
| 3,787,018 | 1/1974 | Nathan | 248/165 |
| 3,801,054 | 4/1974 | Glowacki | 248/188.7 |
| 3,877,669 | 4/1975 | Ambasz | 248/188.7 |
| 4,036,462 | 7/1977 | Sheftel | 248/166 |
| 4,117,784 | 10/1978 | Piretti | 108/150 |
| 4,311,294 | 1/1982 | Hawley | 248/165 |
| 4,351,621 | 9/1982 | Liou | 403/217 |
| 4,433,870 | 2/1984 | Bairen | 297/16 |
| 4,448,378 | 5/1984 | Binfare | 248/165 |
| 4,728,067 | 3/1988 | Steinmetzer | 248/188.7 |

FOREIGN PATENT DOCUMENTS

| | | | |
|---|---|---|---|
| 63474 | 4/1955 | France | 403/218 |
| 430098 | 8/1967 | Switzerland | 248/188.7 |
| 1209765 | 10/1970 | United Kingdom | 248/188.7 |
| 8605373 | 9/1986 | World Int. Prop. O. | 248/188.7 |

*Primary Examiner*—J. Franklin Foss

*Assistant Examiner*—Robert A. Olson

[57] ABSTRACT

A base for furniture pieces such as a single pedestal chair or table comprising a multitude of symetrically designed floor engaging legs. Each leg is formed to provide an elongated run having a floor engaging end and a slightly elevated enlarged flaired inner end, the outer edge of which is concaved so as to provide a semi-circular contour which when the multiple legs are assembled, form a circular hub, which is adapted to receive a swaged metallic sleeve, that in turn receives a furniture support pedestal. Each of the outer edges of the inner end of the legs are internally grooved, with such grooves receiving a positioning ring by which all of the legs are supported in their designed relationship. The positioning ring cooperates with an external bottom support ring, having a diameter sufficient to underlie each of the outer edges of each leg, to secure such legs in their assembled condition.

9 Claims, 2 Drawing Sheets

MULTIPLE LEG FURNITURE BASE

BACKGROUND OF THE INVENTION

Multiple leg furniture bases as disclosed by the prior art include unsightly external structure such as ring clamps and/or collars for securing the legs together at their converging ends, as well as attaching each leg to the vertical furniture support pedestal. These multiple leg bases are unattractive, complicated to assemble, requiring an extreme number of components which in turn were costly and complicated in manufacturing.

Seldom in the prior multiple leg bases did their construction include uniformly designed legs which present complimentary confronting surfaces, which when mated, function to maintain stability to the unified construction. Earlier devices relied upon additional structural elements to achieve this desired result.

SUMMARY OF THE INVENTION

It is a primary object of this invention to improve the functional as well as the aesthetic design of a multiple leg furniture base. To achieve this object there is devised a leg structure that is uniform in deisgn, preferably constructed from laminated wood. The assembled mutliple leg base will appear to be substantially in a flush floor engaging condition, lending itself to extremely stability while adapting itself for use with any form of a single pedestal supported piece of furniture such as a chair, swivel or rocker, or a table.

Another object of this invention is to provide an internal positioning means consisting of a locating ring adapted to be received within a complementary slot formed in the confronting ends of each leg so that when such legs are in their related base forming posture the ring aligns such legs and cooperates therewith to form a hub for the receptin of a pedestal supporting retainer sleeve.

Yet another object of this invention is to provide a connecting means in the form of a circular ring fastened beneath the central hub formed by the mating ends of the legs, including a fastener extending into each leg and its internal positioning ring for securing the entourage in its assembled condition.

A still further object of the invention is to form the legs from laminated wood, thus obtaining the shape and design desired while preserving the textured appearance of wooden legs.

Other objects will appear hereinafter and will be made apparent from a reading of the general description of this invention.

BRIEF DESCRIPTION OF THE DRAWINGS

The invention will be best understood by reference to the accompanying drawings which clearly depict the preferred form of construction and arrangement of parts by which the stated objects of the invention are achieved and in which.

GENERAL DESCRIPTION OF THE INVENTION

Figure 3:
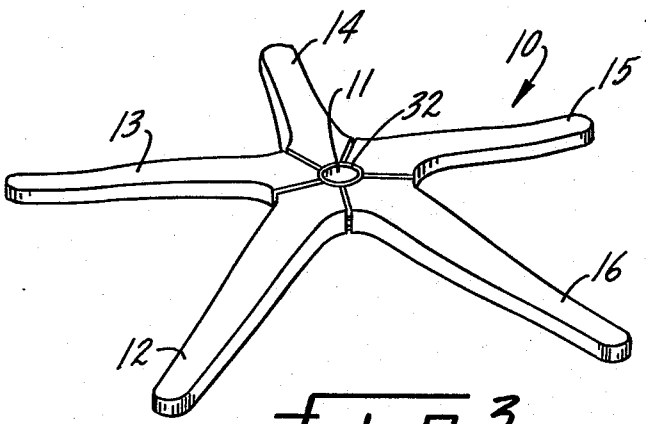
FIG. 3 is a perspective view of the fully assembled multiple leg furniture base of this invention.

The multiple leg base of this invention is identified in the drawings by reference numeral 10. When the multiple legs are in their assembled relationship as viewed in FIG. 3 they will provide a central hub 11 which is adapted to receive and secure in an upright condition a single support pedestal or standard for a piece of furniture such as a chair or table.

The base consists of a plurality of legs 12, 13, 14, 15 and 16. As each leg is of identical design and construction, only one will be described in detail, bearing in mind that the identifying reference numeral as utilized in such description are singularly applicable to the remaining leg structures.

Figure 2:
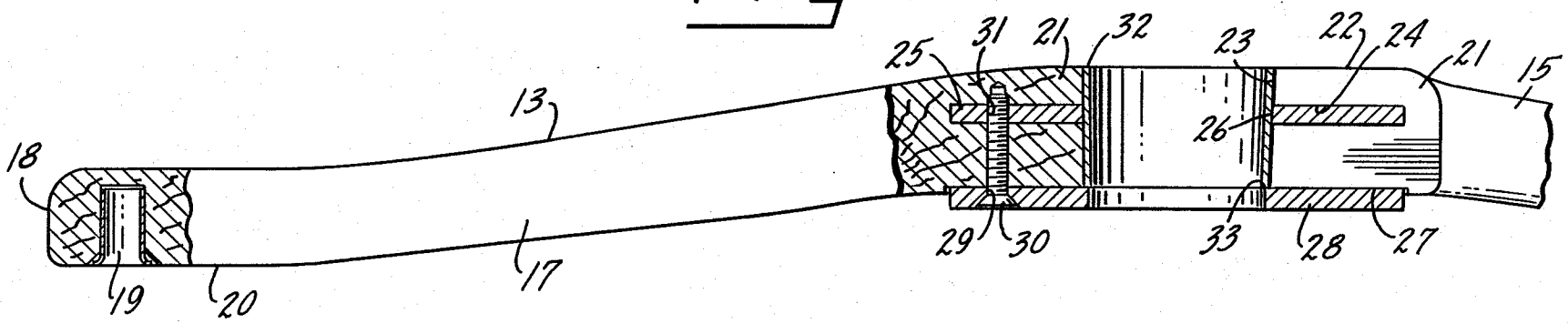
FIG. 2 is a side elevational detailed sectional view of one leg and the central hub formed thereby.

The individual leg 13 as illustrated in FIG. 2 comprises an elongated, substantially rectangularly shaped, run portion 17. The external end 18 of which is provided with a recess 19 having open communication with the underside 20 of the leg 13. This recess 19 is designed to accommodate a caster insert not shown. As viewed in FIG. 2 the run portion 17 of the leg is slightly inclined so as to provide an internal end 21 which is elevated with respect to external end 18 and relative to the floor line.

Figure 1:
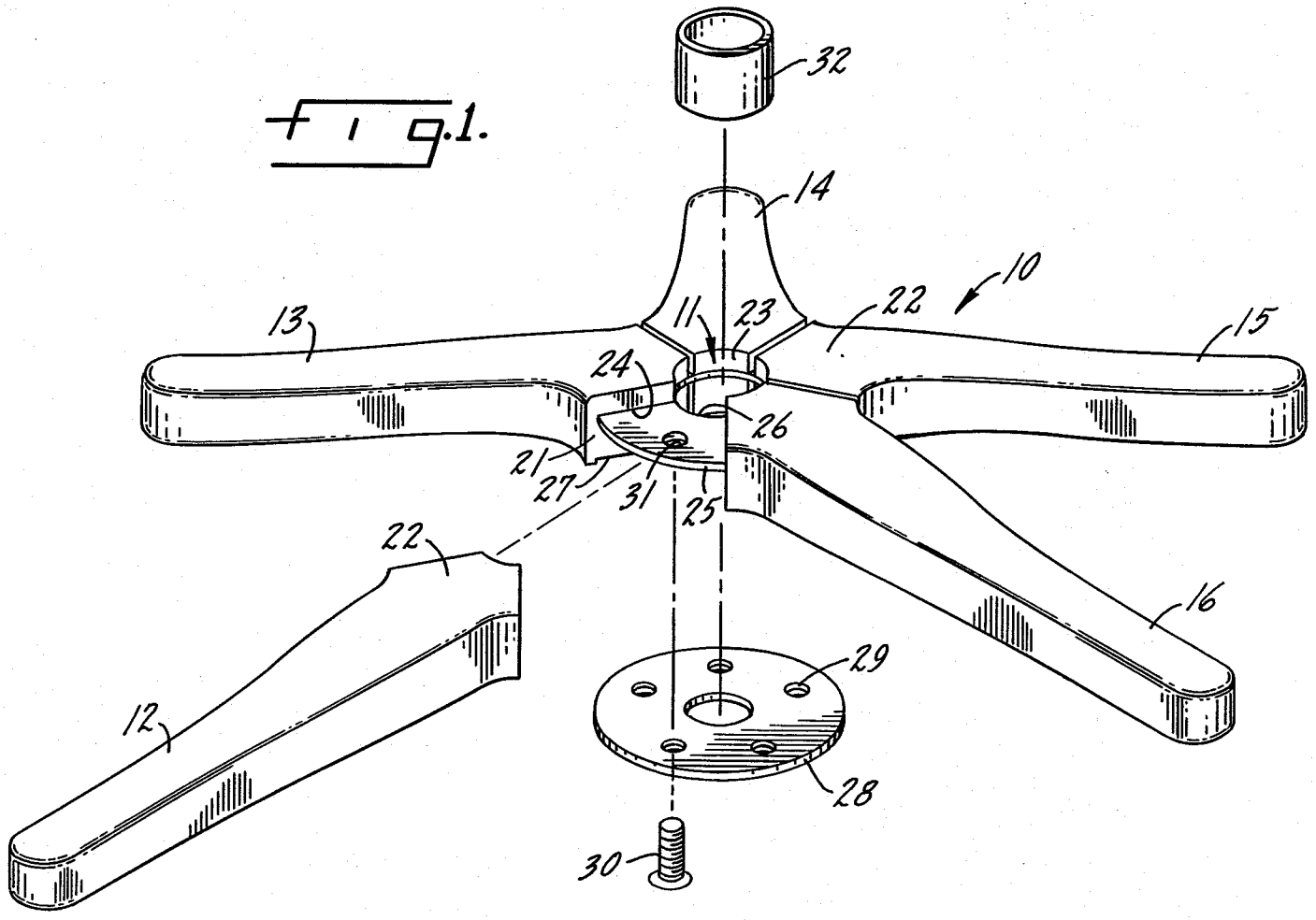
FIG. 1 is a perspective view of a partially assembled leg base with certain parts shown in exploded relationship.

Referring to FIG. 1 it is noted that the internal end 21 of the leg 13 is horizontally flaired to provide an enlarged head portion 22. The outer edge 23 of the enlarged head 22 is concaved so as to form a segment of the circular central hub 11 formed by the assemblage of legs.

Cut inwardly of the enlarged head 22 from the concaved edge 23 is an internal slot 24. This slot is designed to receive a positioning and alinging ring 25. The center opening 26 of the ring 25 has a diameter complementary to that of the center opening of the hub 11.

Figure 5:
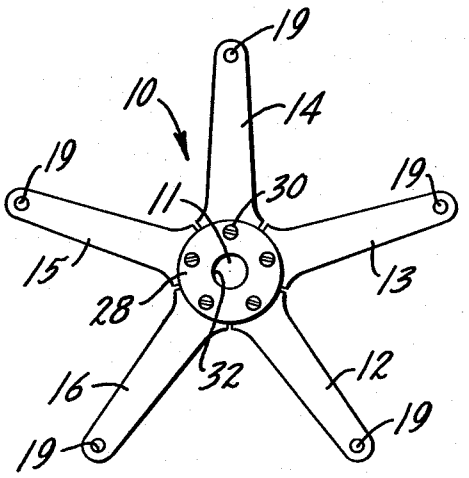
Figure 4:
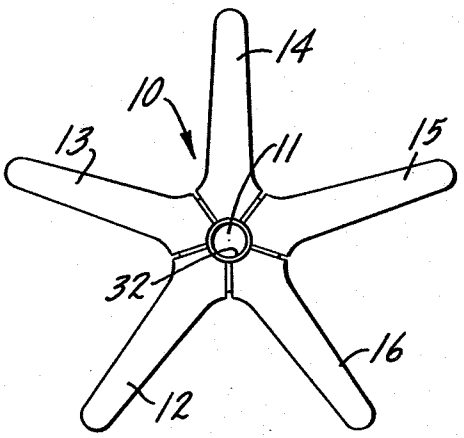
FIG. 4 is a top plan view of fully assembled multiple leg base of this invention and, FIG. 5 is a bottom plan view of the multiple leg base of this invention.

The undersurface of the enlarged head 22 of the leg is relieved so as to provide a depression for the reception of a circular connecting plate 28. This plate 28 is provided with a number of openings 29 which are located on the radial centerl line of each of the legs, as clearly illustrated in FIGS. 1 and 5. A flathead machine screw 30 is adapted to be projected through each of the openings 29 and the enlarged head 22 of the leg and threaded into corresponding aligned openings 31 formed in the positioning and aligning ring 25. By this arrangement each leg is secured to the positioning and aligning ring 25 as well as to the connecting plate 28 to form a unified multiple leg base.

It should be noted that the concaved edge 23 of the leg is tapered inwardly, top to bottom, out of the vertical, and that the center openings of the position and aligning ring 25 and the connecting ring 28 vary in diameter to accommodate this taper. Adapted to be projected into the center opening of the hub 11 is a swaged sleeve 32 which seats on the peripheral edge 33 of the connecting plate 28. This sleeve unifies the hub structure 11 of the base and adds strength and stability thereto when the base receives a supporting pedestal of the associated furniture piece.

To add to the aesthetics of the base, it is preferred that the legs be constructed from a wood lamination so that the desired design as well as the necessary specific shape and elevations of each of the legs can be identical. The appearance of the base is enhanced by the fact that in use there are no structural components visible and the base appears to be of a single unititary construction.

While I have illustrated and described the preferred form of construction for carrying my invention into effect, this is capable of variation and modification without departing from the spirit of the invention. I therefor, do not wish to be limited to the precise details of construction as set forth, but desire to avail myself of such variations and modifications as come within the scope of the appended claims.

Having thus described my invention what I claim as new and desire to protect by Letters Patent is:

1. A base for a piece of furniture comprising:

(a) a plurality of elongated leg members extending radially from a central point of conversion, (b) each of said leg members providing at its converging end a flaired enlargement presenting a concaved edge, with said edge of each leg member cooperating to form a central hub when said legs are in their base forming assemblage, (c) means carried by said concaved edges for positioning said legs in alignment with each other and in a hub forming relation, (d) receiving means on each of said legs for receiving said positioning means, each said receiving means is a radially extending arcuate slot extending between said concaved edge of each leg and an internal concave edge of the slot that is within each leg and that is radially spaced from said concaved edge of each said leg, each said slot has a pair of radially extending edges between said leg concaved edge and said internal concave edge of the slot, and said positioning means projects into each of said slots, whereby said concaved edges of the legs, said radially extending arcuate slots and said positioning means cooperate to define the central hub for said base when said legs are in their base forming assemblage, and said positioning means is enclosed within said leg members, (e) means connecting said converging ends of said legs together and for attaching said positioning means to each of said legs when said positioning means is received in said receiving means, and (f) means within said formed hub for receiving a perpendicular extending pedestal for a piece of furniture to be supported by said base.

2. A base for a piece of furniture as defined by claim 1 wherein said means carried by said concaved edges of said leg members for positioning said legs in alignment with each other and in a hub forming relation comprises a ring member, the center opening of which is of a diameter equal to said hub formed by said assembled leg members.

3. A base for a piece of furniture as defined by claim 1 wherein said means connecting said converging ends of said legs together comprises a circular ring-like plate adapted to be secured to the underside of said flaired enlargement provided by said converging ends of each of said legs.

4. A base for a piece of furniture as defined by claim 3 wherein said means carried by said concaved edges of said leg members for positioning said legs in alignment with each other and in a hub forming relation comprises a ring member the center opening of which is of a diameter equal to said hub formed by said assembled leg members.

5. A base for a piece of furniture as defined by claim 3 wherein said means carried by said concaved edges of said leg members for positioning said legs in alignment with each other and in hub forming relation comprises a ring member adapted to be projected into each of said slots so that said ring member when secured in said slots cooperates with said concaved edges of each leg member to define the central hub for said base.

6. A base for a piece of furniture as defined by claim 1 wherein said means within said formed hub for receiving a perpendicular extending pedestal for a piece of furniture to be supported by said base comprises a sleeve member of a length equal to the height of the flaired enlargement provided at the converging ends of said leg members.

7. A base for a piece of furniture as defined by claim 6 wherein said means carried by said concaved edges of said leg members for positioning said legs in alignment with each other and in a hub forming relation comprises a ring member the center opening of which is equal to the outer diameter of said sleeve member.

8. A base for a piece of furniture as defined by claim 6 wherein said means connecting said converging ends of said legs together comprises a circular ring-like plate secured to the underside of said flaired enlargements provided by each of said legs with the center opening of said ring-like plate having a diameter slightly less than said hub opening formed by said assembled legs so as to provide a shoulder for supporting said sleeve member when said sleeve member is disposed within said formed hub.

9. A multiple leg base for a piece of furniture comprising (a) a plurality of leg members constructed from laminated wood, elongated and having one end slightly elevated out of its normal plane to provide a horizontally flaired enlarged head, (b) each enlarged head providing an exposed concaved edge with each of said concaved edges of each leg complementary to each other so as to form an open center hub for said base when said legs are in their base forming assemblage, (c) means carried by said concaved edge for positioning said heads of each of said legs in alignment with each other and in a hub forming relation, (d) means provided by said concaved edges of said heads for receiving said positioning means, each said receiving means is a radially extending arcuate segment slot extending between said concaved edge of each leg and an internal concave edge of the slot that is radially spaced from said concaved edge of each said leg, each said slot has a pair of radially extending edges between said concaved edge and said internal concave edge of the slot, said positioning means, said radially extending arcuate slots and said concaved edges of the legs cooperate to define the open center hub for said base when said legs are in their base forming assemblage, and said positioning means is enclosed within said leg members, (e) means connecting said heads of said legs together and for attaching said positioning means to each of said legs when said positioning means is received in said receiving means, and (f) means within said open center hub as formed by said heads for receiving a perpendicularly extending pedestal for a piece of furniture to be supported by said base.

* * * * *